US009998828B2

(12) United States Patent
Scheben

(10) Patent No.: US 9,998,828 B2
(45) Date of Patent: Jun. 12, 2018

(54) MEMS MICROPHONE ELEMENT

(71) Applicant: Robert Bosch GmbH, Stuttgart (DE)

(72) Inventor: Rolf Scheben, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 81 days.

(21) Appl. No.: 14/884,959

(22) Filed: Oct. 16, 2015

(65) Prior Publication Data

US 2016/0112803 A1 Apr. 21, 2016

(30) Foreign Application Priority Data

Oct. 16, 2014 (DE) ..... 10 2014 221 037

(51) Int. Cl.
*H04R 7/10* (2006.01)
*H04R 19/00* (2006.01)
*H04R 19/04* (2006.01)

(52) U.S. Cl.
CPC ..... *H04R 7/10* (2013.01); *H04R 19/005* (2013.01); *H04R 19/04* (2013.01)

(58) Field of Classification Search
CPC . H04R 7/10; H04R 1/04; H04R 1/342; H04R 19/005; H04R 19/04; H04R 9/08; H04R 2410/07; H04R 2307/027; H04R 19/016; H04R 19/01; H04R 2307/023; H04R 7/06; H04R 7/125; B29C 70/086; Y10T 29/49005; B32B 3/12
See application file for complete search history.

(56) References Cited

U.S. PATENT DOCUMENTS 4,471,028 A * 9/1984 Kimura ..... H04R 7/10 148/403
5,851,336 A * 12/1998 Cundiff ..... B29C 70/086 156/272.2
6,535,460 B2 * 3/2003 Loeppert ..... B81B 3/0072 367/181
8,073,179 B2 * 12/2011 Wu ..... H04R 19/005 381/162
8,983,106 B2 * 3/2015 Akino ..... H04R 9/08 381/356
9,237,402 B2 * 1/2016 Loeppert ..... H04R 19/005
(Continued)

*Primary Examiner* — Fan Tsang
*Assistant Examiner* — Angelica M McKinney
(74) *Attorney, Agent, or Firm* — Norton Rose Fulbright US LLP; Gerard Messina

(57) ABSTRACT

A concept is provided which permits the implementation of MEMS microphone elements having a very good SNR, high microphone sensitivity and a large frequency bandwidth. The microphone structure of the MEMS element is implemented in a layer structure and includes at least one sound pressure-sensitive diaphragm (210), an acoustically permeable counter element (220) and a capacitor system for detecting the diaphragm deflections, the diaphragm (210) and the counter element (220) being situated on top of each other and a distance apart from one another in the layer structure and each bring equipped with at least one electrode of the capacitor system. According to the invention, the layer structure of the diaphragm (210) includes at least one thin closed layer (1) and at least one thick structured layer (2), a grid structure (100) covering the entire diaphragm area being provided in the thick layer (2), which determines the stiffness of the diaphragm (210).

13 Claims, 3 Drawing Sheets

(56) References Cited

U.S. PATENT DOCUMENTS

| | | | | |
|---|---|---|---|---|
| 2009/0296963 | A1* | 12/2009 | Akino | H04R 7/14<br>381/174 |
| 2010/0135123 | A1* | 6/2010 | Fischer | H04R 19/005<br>367/181 |
| 2014/0270271 | A1* | 9/2014 | Dehe | B81B 3/0018<br>381/174 |
| 2015/0237448 | A1* | 8/2015 | Loeppert | H04R 7/08<br>257/416 |

* cited by examiner

MEMS MICROPHONE ELEMENT

BACKGROUND OF THE INVENTION

1. Field of the Invention

The present invention relates to a MEMS (microelectrical mechanical system) element having a microphone structure implemented in a layer structure. The microphone structure includes at least one sound pressure-sensitive diaphragm, an acoustically permeable counter element and a capacitor system for detecting diaphragm deflections. The diaphragm and the counter element are situated on top of each other, spaced a distance apart, in the layer structure of the element, and each is equipped with at least one electrode of the capacitor system.

2. Description of the Related Art

Under the impact of sound, the microphone diaphragm is deflected at a right angle to the planes of the layers of the layer structure. Thereby the distance between the microphone diaphragm and the stationary counter element changes. The microphone diaphragm and the counter element are each equipped with at least one capacitor electrode, so that the "out-of-plane" deflections of the microphone diaphragm are detectable as changes in capacitance of the capacitor system. However, the connection of the diaphragm to the layer structure of the element causes bending or warping of the diaphragm, which may have negative effects on the microphone performance. In particular such a warping may result in the relationship between the diaphragm deflection and the measuring signal being no longer linear at higher sound pressures.

A high signal-to-noise ratio (SNR) is always sought with high-performance MEMS microphones. One possibility for improving the SNR is to reduce the flow resistance of the counter element.

In addition, for high-performance MEMS microphones, a preferably large frequency bandwidth is frequently sought, i.e., a preferably flat response function, which also includes high frequencies, ideally into the ultrasonic range. The microphone structure is advantageously designed to have a preferably high resonant frequency co. The greater the response function of the upper cutoff frequency, the higher is the resonant frequency co of a capacitive MEMS microphone. Resonant frequency co depends decisively on the mass and stiffness of the microphone diaphragm. The thinner the diaphragm having a given diaphragm area and diaphragm stiffness, the higher is the resonant frequency. In a homogeneous diaphragm, however, the stiffness also depends on the thickness of the diaphragm. The lower stiffness of a thin microphone diaphragm in turn favors its warping, which has negative effects on the microphone performance, and results in nonlinearities in the microphone signal as well as a reduction of the resonant frequency. A high resonant frequency and good microphone performance are therefore not readily compatible.

BRIEF SUMMARY OF THE INVENTION

The present invention enables the implementation of MEMS microphone elements having a very good SNR, high microphone sensitivity and a large frequency bandwidth.

According to the present invention, this is achieved by the fact that the layer structure of the diaphragm includes at least one thin closed layer and at least one thick structured layer, a grid structure covering the entire diaphragm area being provided in the thick layer and determining the stiffness of the diaphragm.

According to the present invention, it has been found that the diaphragm of a MEMS microphone element may also be constructed from multiple layers and that these diaphragm layers may be structured independently of one another.

It has also been found that diaphragms having a comparatively low mass with a comparatively high stiffness are implementable with the aid of a grid structure in a thicker diaphragm layer. According to the present invention, this diaphragm concept is to be used within the scope of a MEMS microphone element since a comparatively high resonant frequency and a good SNR are both achievable in this way. The noise component is reduced at least at higher frequencies due to the measures according to the present invention.

There are basically many different options for the implementation of the concept according to the present invention, in particular with regard to the layer structure of the diaphragm and the layout of the grid structure.

Thus, the at least one thin closed diaphragm layer is advantageously made of an electrically conductive material, such as polysilicon, for example, so that this layer or at least an area of this layer may function as an electrode of the capacitor system. The grid structure may in this case be provided simply in a thicker silicon oxide layer, for example. This is advantageously situated between the closed diaphragm layer and the stationary counter element, so that it forms an electrical insulation between the diaphragm electrode and the counter element having at least one counter electrode of the capacitor system. In this case, the grid structure functions not only for reinforcing the diaphragm but also as a stop and overload protection for the diaphragm.

The concept according to the present invention offers the possibility of influencing the stiffness of the diaphragm in a targeted manner through the layout of the grid structure to thereby configure MEMS microphone elements with a preselectable defined characteristic.

If the diaphragm is tied into the layer structure of the MEMS element via spring elements, then a uniform stiffness over the entire diaphragm area is generally sought in order to obtain a preferably linear relationship between the diaphragm deflection and the change in capacitance. A uniform stiffness may advantageously be achieved by the grid structure having the same web width in the entire diaphragm area and/or having the same mesh size, and the layer thickness of the grid structure is uniform in the entire diaphragm area.

If the boundary area of the diaphragm is circumferentially tied completely to the layer structure of the MEMS element, then the central portion of the diaphragm is generally stiffened with respect to the boundary area of the diaphragm, so that the central portion together with the diaphragm electrode is preferably deflected in a plane-parallel manner. In this case, it has proven to be advantageous for the grid structure to have different web widths and/or different mesh sizes in the individual diaphragm areas, the boundary area and the central portion, and/or for the layer thickness of the grid structure to be different in the individual diaphragm areas, namely in such a way that preferably only the boundary area is deformed under the impact of sound.

The microphone performance is influenced not only by the mass and stiffness of the diaphragm but also by the type of connection to the layer structure of the MEMS element. This design parameter may thus also be utilized for targeted configuration of the microphone characteristic.

As already mentioned, the boundary area of the diaphragm may be circumferentially tied completely to the layer structure of the MEMS element or only via spring elements. In both embodiment variants, the diaphragm connection may be provided in the thin layer and/or in the thick layer of the layer structure of the diaphragm.

If the thin closed diaphragm layer including the diaphragm electrode(s) is situated on the side of the diaphragm facing the counter element, then the distance between the electrodes of the capacitor system may be selected to be very small. In this case, the capacitance at rest of the capacitor system is accordingly high.

Alternatively, however, the thin closed diaphragm layer may also be situated on the side of the diaphragm facing away from the counter element. The advantage of this variant is the comparatively low flow resistance, which has a positive effect on the SNR of the microphone element.

DETAILED DESCRIPTION OF THE INVENTION

Figure 1:
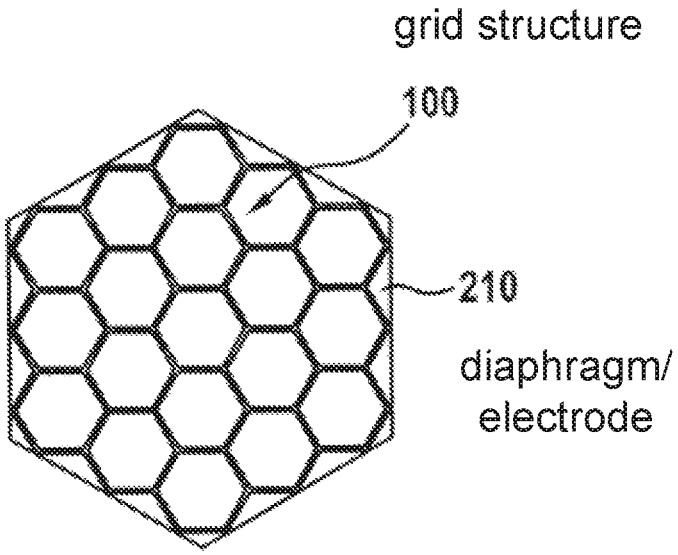
FIG. 1 shows a honeycomb-type grid 100.

Grid 100 shown in FIG. 1 is a cohesive lattice having a hexagonal lattice mesh of the same size and uniform lattice thickness, which extends over the entire area of a diaphragm 210, which is also hexagonal. This shape of a lattice is an example of a grid designed according to the present invention in at least one layer of the layer structure of a MEMS diaphragm in order to implement a MEMS diaphragm having a preferably low mass and a defined stiffness, which is largely independent thereof.

The layer structure of such a MEMS diaphragm includes at least one thin closed layer and at least one thick layer. The grid structure should be provided only in the thick layer, namely in such a way that it covers the entire diaphragm area.

It should be pointed out explicitly here that the grid structure may also have a different shape than the cohesive uniform lattice illustrated in FIG. 1. The grid structure may also have, for example, a regular arrangement of individual webs. The grid structure also need not be uniform in the entire diaphragm area. For example, individual diaphragm areas may be equipped with a grid structure of a different mesh size and/or different web width. The layer thickness in which the grid structure is provided may be different in individual diaphragm areas.

The diaphragm layer structure provided here having a thin closed layer and a thick layer, in which a grid structure is provided, is suitable in particular for diaphragms of high-performance capacitive MEMS microphone elements. With these elements, the microphone structure is implemented in a layer structure and includes, in addition to the sound pressure-sensitive diaphragm, at least one acoustically permeable counter element. These two elements of the microphone structure are situated on top of each other and spaced a distance apart in the layer structure, and each is equipped with at least one electrode of a capacitor system for detecting the diaphragm deflections.

The boundary connection and the stiffness in the central portion of the diaphragm are advantageously designed in such a way that the central portion having the diaphragm electrode(s) is deflected essentially in a plane-parallel manner under the impact of sound, whereas the main deformation takes place in the boundary area or in the connecting area of the diaphragm. This area is generally free of electrodes and therefore does not contribute toward the capacitance or the change in capacitance of the capacitor system.

Figure 2A:
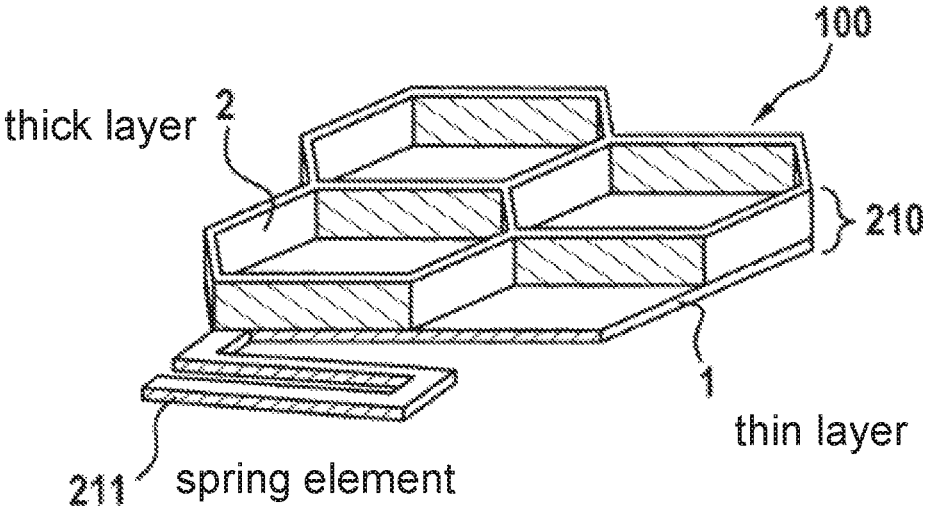
FIGS. 2*a*-2*c* show perspective views of a boundary section of diaphragm 210 of a MEMS element according to the present invention.
Figure 2B:
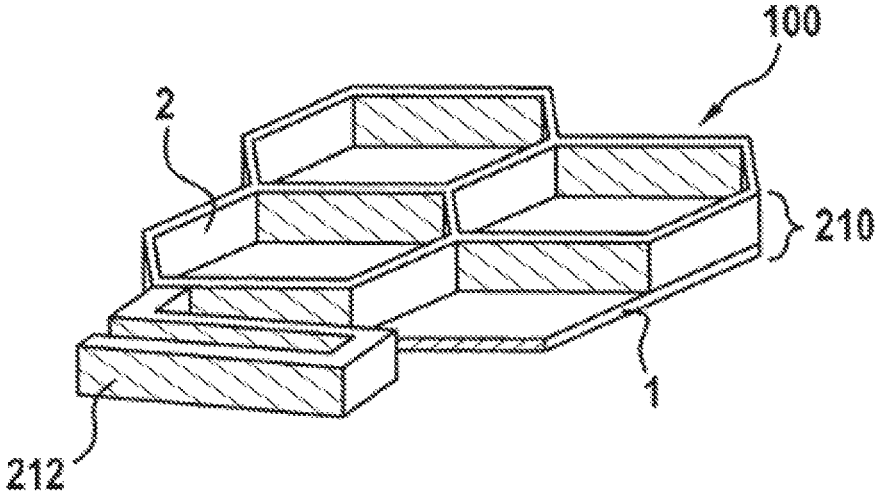
Figure 2C:
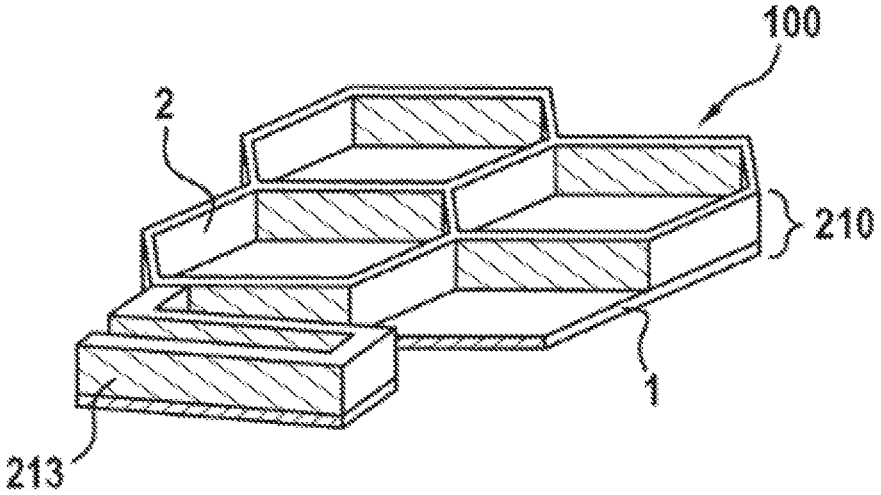

The boundary area of the diaphragm may either be circumferentially tied more or less to the layer structure of the MEMS element or via spring elements, as illustrated in FIGS. 2*a* through 2*c*.

In the embodiment variant illustrated in FIG. 2*a*, spring elements 211 are provided exclusively in thin closed layer 1 of the layer structure of diaphragm 210. In contrast thereto, in the case of FIG. 2*b* spring elements 212 are implemented exclusively in thick layer 2 of the layer structure of diaphragm 210, out of which the grid structure 100 is also structured to reinforce diaphragm 210. Finally, FIG. 2*c* shows an embodiment variant in which spring elements 213 extend over both layers 1 and 2 of the layer structure of diaphragm 210.

As already mentioned, sound pressure-sensitive diaphragm 210 and stationary counter element 220 are situated on top of each other in the layer structure and spaced a distance apart from one another. In the exemplary embodiments described here, a grid-type system of through-openings 221 is provided in counter element 220, so that counter element 220 is acoustically permeable. Since the layer structure of diaphragm 210 is not symmetrical with thin closed layer 1 and thick structured layer 2, this yields the two design variants illustrated in FIGS. 3*a* and 3*b*.

Figure 3A:
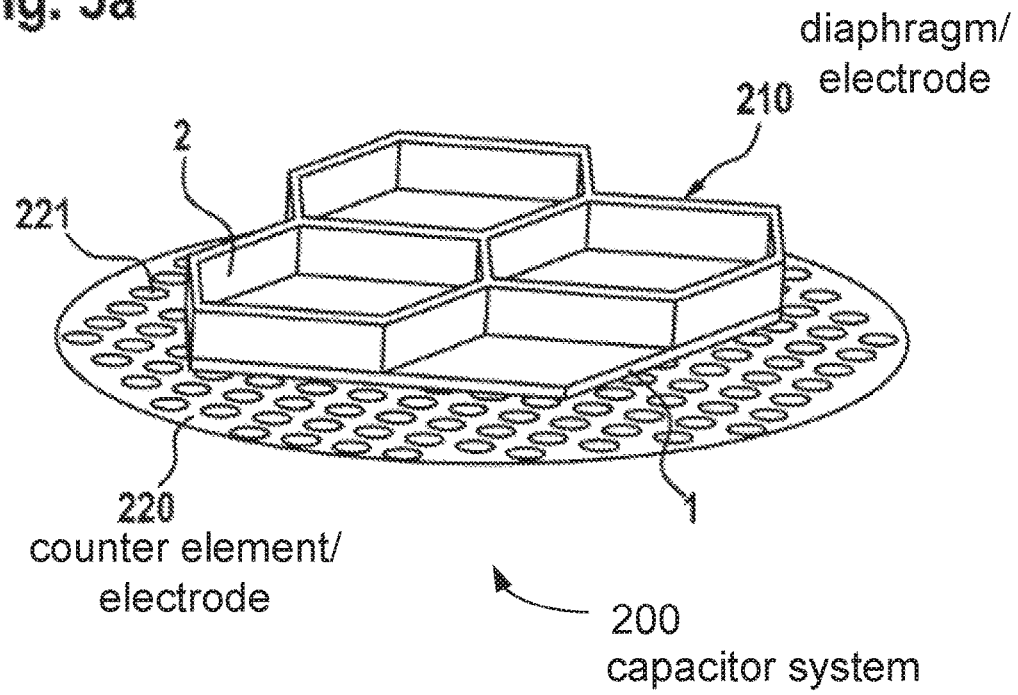
FIGS. 3*a*-3*b* show perspective views of possible orientations and arrangements of a capacitor system 200, diaphragm 210 and counter element 220 of a MEMS element according to the present invention.
Figure 3B:
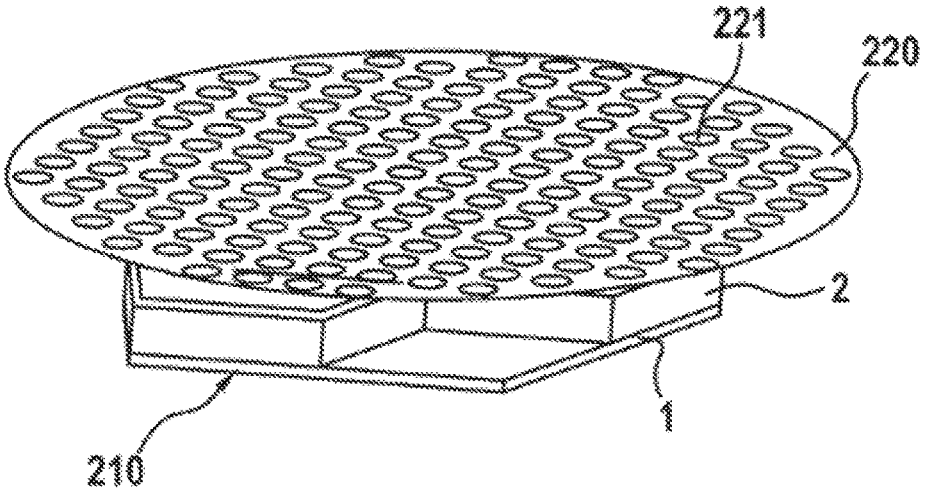

In the case of FIG. 3*a*, diaphragm 210 and counter element 220 are situated in such a way that thin closed diaphragm layer 1, including the diaphragm electrode, is situated on the side facing counter element 220. In this variant, particularly small distances between the diaphragm electrode and the counter electrode may be implemented. Accordingly, the capacitor system 200 in this case has a relatively high basic capacitance. In contrast thereto, thin closed diaphragm layer 1, including the diaphragm electrode, is situated on the side facing away from counter element 220 in the case of FIG. 3*b*, so that there is a greater distance and a lower flow resistance accordingly between closed layer 1 of diaphragm 210 and counter element 220. Furthermore, grid structure 100 in thick layer 2 of the diaphragm layer structure may be utilized here as overload protection for diaphragm 210.

What is claimed is:

1. A MEMS element including a microphone structure implemented in a layer structure, comprising:

a sound pressure-sensitive diaphragm;

an acoustically permeable counter element; and a capacitor system for detecting diaphragm deflections;

wherein:

the diaphragm and the counter element are situated on top of each other and spaced apart at a distance in the layer structure;

the diaphragm and the counter element are each equipped with at least one electrode of the capacitor system; and the layer structure of the diaphragm includes at least one thin closed layer and at least one thick structured layer, a grid structure covering the entire diaphragm area being provided in the at least one thick structured layer, said grid structure determining the stiffness of the diaphragm, wherein the at least one thick structured layer is disposed directly on and abuts the at least one thin closed layer, and wherein the at least one thick structured layer is a silicon oxide layer and the grid structure is disposed in the silicon oxide layer between a diaphragm electrode and a counter element electrode.

2. The MEMS element as recited in claim 1, wherein the grid structure has at least one of (i) a same web width and (ii) a same mesh size in the entire diaphragm area.

3. The MEMS element as recited in claim 1, wherein the grid structure has at least one of (i) different web widths and (ii) different mesh sizes in individual diaphragm areas.

4. The MEMS element as recited in claim 1, wherein the layer thickness of the grid structure is uniform in the entire diaphragm area.

5. The MEMS element as recited in claim 1, wherein the layer thickness of the grid structure in individual diaphragm areas is different.

6. The MEMS element as recited in claim 1, wherein a honeycomb-type web structure is provided as the grid structure in the at least one thick structured layer of the diaphragm.

7. The MEMS element as recited in claim 1, wherein a boundary area of the diaphragm is circumferentially tied completely to the layer structure of the MEMS element.

8. The MEMS element as recited in claim 7, wherein the boundary area of the diaphragm has at least one corrugation.

9. The MEMS element as recited in claim 7, wherein the boundary area of the diaphragm is tied to the layer structure of the MEMS element via spring elements.

10. The MEMS element as recited in claim 7, wherein a connection of the diaphragm to the layer structure of the MEMS element is provided at least one of (i) in the thin layer and (ii) in the at least one thick structured layer of the layer structure of the diaphragm.

11. The MEMS element as recited in claim 1, wherein the thin closed diaphragm layer is provided one of (i) on the side of the diaphragm facing the counter element or (ii) on the side of the diaphragm facing away from the counter element.

12. The MEMS element as recited in claim 1, wherein a deformation of the diaphragm occurs at a boundary area disposed at an edge of the diaphragm and between the diaphragm and the MEMS element, wherein the boundary area is free of electrodes of the capacitor system.

13. The MEMS element as recited in claim 1, wherein the grid structure has no cover and is upwardly open.

* * * * *